US005215141A

United States Patent [19]

Kuhn et al.

[11] Patent Number: 5,215,141

[45] Date of Patent: Jun. 1, 1993

[54] APPARATUS AND METHOD FOR CONTROLLING THE COUNTERGRAVITY CASTING OF MOLTEN METAL INTO MOLDS

[75] Inventors: John W. Kuhn, Bristol; Richard J. Wylie, Wabash, both of Ind.

[73] Assignee: CMI International, Inc., Bristol, Ind.

[21] Appl. No.: 897,338

[22] Filed: Jun. 11, 1992

[51] Int. Cl.[5] ..... B22D 18/04; B22D 18/08; B22D 35/04

[52] U.S. Cl. ..... 164/457; 164/133; 164/147.1; 164/155; 164/337; 164/500

[58] Field of Search ..... 164/457, 500, 147.1, 164/113, 120, 133, 155, 337

[56] References Cited

U.S. PATENT DOCUMENTS

| | | | |
|---|---|---|---|
| 3,842,893 | 10/1974 | Booth | 164/457 |
| 3,844,331 | 10/1974 | Py et al. | 164/457 |
| 3,961,662 | 6/1976 | Balevski et al. | 164/457 |
| 4,213,494 | 7/1980 | Carbonnel | 164/457 |
| 4,585,050 | 4/1986 | Merrien et al. | 164/457 |
| 4,714,102 | 12/1987 | Koya | 164/457 |
| 4,741,381 | 5/1988 | Nishida et al. | 164/457 |
| 4,860,820 | 8/1989 | Pereira | 164/457 |
| 4,967,827 | 11/1990 | Campbell | 164/134 |

FOREIGN PATENT DOCUMENTS

| | | | |
|---|---|---|---|
| 52-33831 | 3/1977 | Japan | 164/147.1 |
| 61-132258 | 6/1986 | Japan | 164/155 |

*Primary Examiner*—J. Reed Batten, Jr.

*Attorney, Agent, or Firm*—Reising, Ethington, Barnard, Perry & Milton

[57] ABSTRACT

A countergravity low-pressure casting apparatus (10) includes a feedback control system (98) which continuously measures the actual pressure of metal being pumped into a mold (12) and controls the voltage applied to an electromagnetic pump (66) to conform the actual metal pressure with the ideal metal pressure versus casting cycle time fill schedule (96).

26 Claims, 2 Drawing Sheets

AR
PT
DPC
PLC

APPARATUS AND METHOD FOR CONTROLLING THE COUNTERGRAVITY CASTING OF MOLTEN METAL INTO MOLDS

BACKGROUND OF THE INVENTION

1. Technical Field

The present invention relates to low pressure countergravity metal casting systems for countergravity casting molten metal articles under low pressure and more particularly to such systems having control systems for controlling the flow of the molten metal into the casting mold.

2. Description of Related Prior Art

Conventional low pressure casting systems typically comprise a casting mold supported above a furnace of molten metal and includes some means for forcing the metal from the furnace upwardly into a casting cavity within the mold. Some systems utilize pressurized gas to feed the molten metal while others employ an electromagnetic pump.

With either type of system it is important to precisely control the flow of the molten metal into the mold in order to achieve good castings. This is particularly true when casting thin-walled articles. Filling the mold cavity too fast tends to leave the thin sections of the cavity unfilled, whereas filling too slow allows for premature solidification producing porosity defects in the resultant cast article.

For those systems employing electromagnetic pump, the ideal manner in which the mold should be filled can be determined and expressed in terms of an ideal pressure of the pumped metal versus casting cycle time. Since the pump is electromagnetic, its pressure output is a function of the voltage applied to the pump. By simply controlling the voltage applied to the pump as a function of time, one known system attempts to conform the actual filling conditions with the desired ideal conditions. This time-dependent system, however, is deficient in that it fails to take into account the effects that varying metal temperature has on the pressure output of the pump as well as the changing relationship between the pressure output of the pump and the applied voltage as the pump wears and the varying relationship of the pressure output to the applied voltage as between different pumps. Furthermore, the accuracy of this type of control system is dependent upon the metal level starting out at the same level for each casting cycle. If the metal level starts out too high, then the thin sections of the mold cavity will likely not be filled and further the molten metal will likely penetrate the sand mold as well as produce unwanted flashes at the parting line of the mold.

Other control systems have been developed which address the deficiencies of the time-controlled system but which themselves suffer from various other deficiencies. For example, one control system is known in which induction sensors are positioned around the mold for detecting the actual level of the molten metal as it rises in the mold. The sensor then controls the output of the pump in order to conform the actual filling of the mold with an ideal metal level versus casting cycle time schedule. This system, however, can not be used when other metal objects are present in the mold cavity. Such is the case, for example, when casting cylinder blocks with cast-in-place metal cylinder liners. The liners interfere with the sensor's ability to detect and monitor the position of the metal in the mold.

Another known system monitors the temperature of the metal as it rises in the mold. The output of the pump is then controlled so that the actual metal temperature conforms with a predetermined ideal metal temperature versus casting time schedule. This control system, however, requires that each mold be fitted with numerous temperature sensors (i.e., thermal couples) which would be undesirable for production level casting and costly.

Accordingly, there is a need in the industry for a control system which can precisely control the output of an electromagnetic pump but yet is practical and suitable for production rate casting.

SUMMARY OF THE INVENTION AND ADVANTAGES

The present provides a counter gravity casting apparatus which comprises a mold having a cavity therein with a bottom inlet into said cavity. The mold is supported above a reservoir means which is provided for holding a supply of molten metal to be countergravity cast into the mold. Pump means are provided and operatively associated with the reservoir means for countergravity pumping the molten metal against gravity from the reservoir means into the mold through the bottom inlet. The characterizing feature of the casting apparatus is feedback control means for continuously measuring the actual pressure of the pumped metal during the casting cycle and controlling the output of the pump means for conforming the actual pressure with a preselected reference metal pressure versus casting cycle time mold filling schedule.

A method is also contemplated and comprises the steps of countergravity pumping the molten metal into the mold with a pump and characterized by continuously measuring the actual pressure of the pumped metal during the casting cycle and controlling the output of the pump to conform the actual metal pressure with a preselected reference metal pressure versus casting cycle time mold fill schedule.

One advantage of the present invention is that the actual output of the pump is measured and then used to make necessary corrections for conforming the actual metal pressure with the ideal metal pressure versus casting cycle time. This allows the system to accommodate varying metal temperatures and starting levels as well as differences in the pressure output versus applied voltage characteristics of a pump due to wear or as between different pumps.

This control system also permits metal articles to be cast-in-place within the mold and further does not require specially modified molds as with prior art systems.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
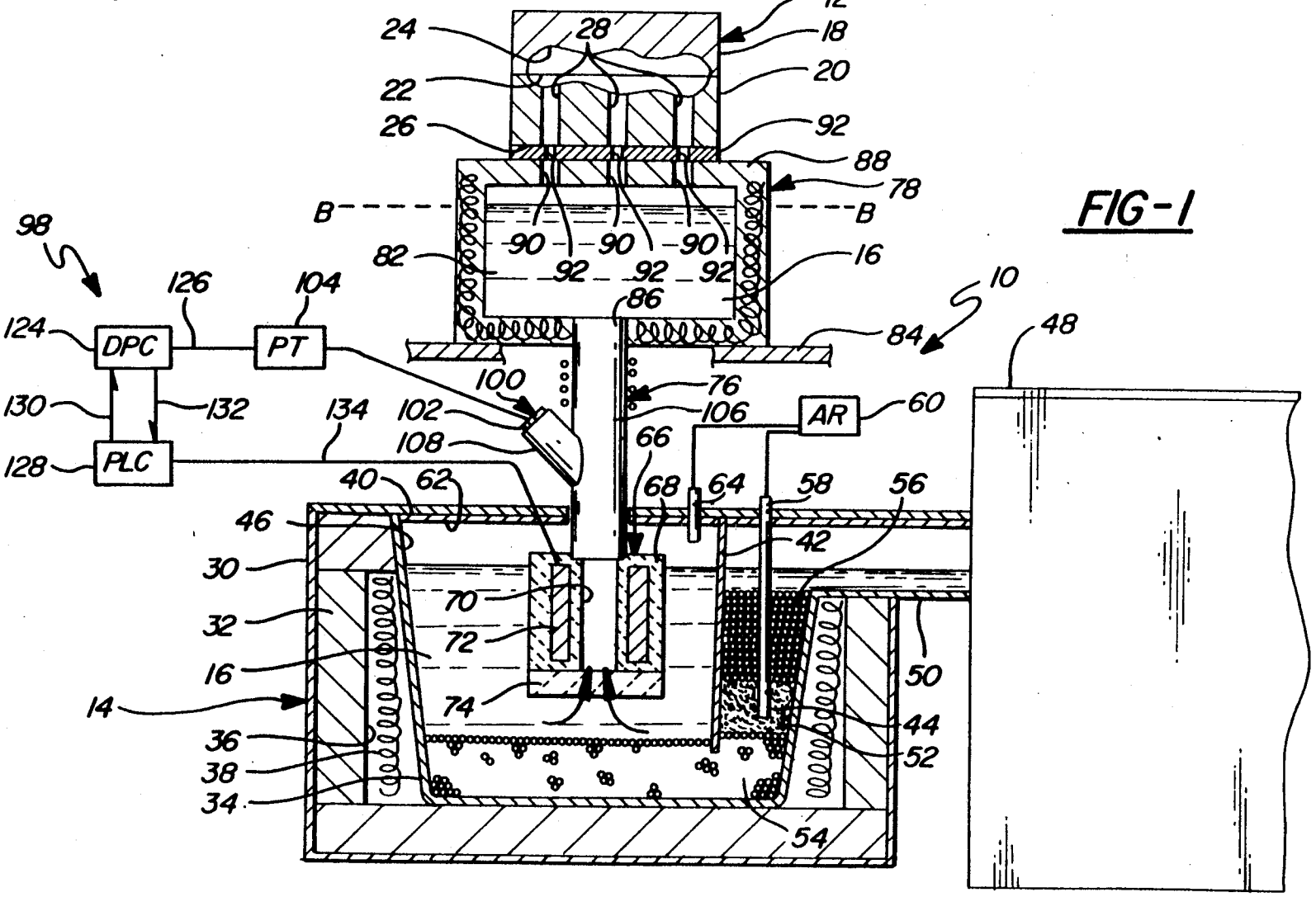
FIG. 1 is a simplified diagrammatic view of an apparatus according to the present invention.

A preferred embodiment of an apparatus constructed in accordance with the present invention is generally shown at 10 in FIG. 1.

The apparatus 10 comprises a casting mold 12 situated above a reservoir 14 containing a supply of molten metal 16, such as molten aluminum, which is to be delivered into the mold 12.

The casting mold 12 comprises an upper mold half (cope) 18 which is joined to a lower mold half (drag) 20 along parting line 22 and defining a mold cavity 24 therebetween. Extending upwardly from a bottom side 26 of the mold 12 is a plurality of inlet feed gates 28 establishing fluid communication between the mold cavity 24 and the bottom side 26 of the mold. The mold 12 is preferably fabricated of resin-bonded silica sand and according to conventional foundry mold making practice but may be constructed from other conventional foundry mold materials and according to other conventional practice. Metal dies may also be used.

The reservoir 14 is a modified 181 Alcoa filtering and degassing crucible furnace. Such a crucible furnace 14 comprises a metal outer shell 30 lined with an insulating refractory liner 32 and accommodating a crucible or vessel 34 therein. The side walls of the crucible 34 are spaced from the liner 32, which space 36 accommodates induction heating coils 38 connected to a suitable power source (not shown) for heating molten metal 16 within the crucible 34 and maintaining its temperature to within ±5° F. of a predetermined casting temperature and, more preferably, to within ±3° F. of that temperature. With aluminum-based metal, the desired casting temperature is between 1250°–1280° F.

An insulated cover 40 has been added to the furnace 14 and comprises a metal plate lined with an insulating refractory material. The cover 40 assists the heating coils 38 in maintaining the metal to within the desired temperature range.

Extending downwardly from the cover 40 and into the crucible 34 is a weir 42 which partitions the crucible 34 into separate receiving and casting chambers 44 and 46 respectively. The extended free end of the weir 42 is spaced from the bottom of the crucible 34 and provides a fluid passageway or opening between the chambers 44 and 46.

The receiving chamber 44 is coupled to a metal supply furnace 48 with a heated and insulated launder or trough 50. The metal supply furnace 48 is a commercially available gas reverb high-efficiency type furnace used for melting the metal and heating it to approximately the casting temperature before delivery to the crucible furnace 14. Molten metal from the supply furnace 48 is directed into the top of the receiving chamber 44 where it thereafter travels downwardly through the chamber 44, beneath the weir 42 and into the casting chamber 46. The receiving chamber 44 has a filter media 52 disposed therein above the fluid passage in the weir 42 and through which the molten metal 16 must pass before entering the casting chamber 46. The filter media 52 is preferably an alumina flake material supported off the bottom of the crucible 34 by a bed of ceramic beads 54 and similarly covered with another layer of ceramic beads 56.

Extending down through the cover 40 and into the filter media 52 is a lance 58 connected at its inlet side to an inert gas source 60, such as argon or nitrogen, for bubbling inert gas into the filter media 52. When the molten metal is passed through the filter media 52, any undesirable inclusions such as oxides, are trapped and filtered from the metal before it enters the casting chamber 46. Further, when casting molten aluminum metal, the filter media 52 and inert gas 58 together filter out any hydrogen gas dissolved in the aluminum (which has a natural affinity for hydrogen) before the aluminum enters the casting chamber 46. The scavenged hydrogen attaches to the argon bubbles introduced into the filter media 52 and then rises to the surface of the melt with the argon bubbles to prevent the hydrogen from contaminating the molten metal in the casting chamber 46. Hydrogen is an undesirable component when casting aluminum since its affinity for hydrogen decreases with cooling causing the hydrogen to come out of solution in the form of bubbles during solidification and thereby produce undesirable porosity defects in the resultant cast article.

The molten metal 16 is maintained at a substantially constant level in the casting chamber 46 with there being an enclosed air space 62 between the upper surface of the metal 16 and the cover 40 overlying the chamber 46. Extending through the cover 40 and into the air space 62 is another lance 64 coupled to the same or different inert gas source 60. The lance 64 directs a positive flow of the inert gas (e.g., argon or nitrogen) into the air space 62 and purges the space 62 of any external atmospheric gases which would otherwise react with and recontaminate the metal in the casting chamber 46 with oxide inclusions and hydrogen. The inert gas thus provides an inert, nonreactive atmosphere to the filtered and degassed metal to protect it against recontamination from the external atmosphere. It is insufficient, however, for applying enough pressure to the metal in the chamber 46 to cause the metal to be delivered into the mold 12. There is essentially no differential pressure between the casting chamber 46 and the mold cavity 24 but for the positive flow of purging gas into the chamber 46 (less than 1 psi). The cover 40 does not seal the chamber 46 air tight but rather enables contaminating atmospheric gases, to escape from the chamber 46 through the cover 40 and enables a positive flow of purging gas to be maintained without excessively pressuring the chamber 46.

Pump means, and preferably an electromagnetic pump 66, is immersed in the metal contained in the casting chamber 46 of the crucible furnace 14 and is responsive to an input voltage applied thereto for pumping the molten metal 16 against gravity from the furnace 14 into the cavity 24 of the mold 12 through the bottom feed gates 28 thereof. The pump 66 has a refractory housing 68 defining a vertical channel 70 extending internally therethrough between a bottom inlet and a top outlet thereof. An electromagnetic 72 is supported within the housing 68 and is responsive to the applied voltage for applying electromagnetic energy to the molten metal contained in the vertical channel 70 to force it upwardly according to the right hand motor rule. A ceramic porous filter 74 covers the inlet of the pump 66 and further filters any oxide inclusions from the metal before delivery into the mold 12. The electromagnetic pump 66 may be of any type, such as model PG-450 commercially available from CMI Novacast, Inc., 190 Kelly Street, Elk Grove Village, Ill. 600007.

The bottom inlets 28 of the mold 12 are coupled to the outlet of the electromagnetic pump 66 by a heated vertical delivery system comprising a heated refracted feed tube 76 and a heated distribution vessel 78. The distribution vessel 78 is supported above the crucible furnace 14 on support surface 84 and has heated refractory walls defining a holding chamber 82 therein. The holding chamber 82 is of appreciably less volume capacity than either the crucible furnace 14 or the metal supply furnace 48.

The feed tube 76 is connected at its bottom end to the outlet of the pump 66 and from there extends vertically upwardly and is coupled to a single bottom inlet 86 of the distribution vessel 78 for establishing fluid communication between the distribution vessel 78 and the casting chamber 46.

The mold 12 is supported above the crucible furnace 14 by a top wall 88 of the distribution vessel 78. The top wall 88 is fabricated of refractory material and formed with a plurality of distribution holes 90 therethrough corresponding in number, arrangement and approximate size to the plurality of bottom feed gates 28 of the mold 12 and in registry therewith for establishing fluid communication between the holding chamber 82 and the mold cavity 24. The particular size, number and arrangement of the feed gates 28 and holes 90 are dependent on the configuration of the cavity 24 and selected so as to deliver and distribute the molten metal directly into the cavity 24 at various locations without the need for a gating system. A refractory orifice gasket or plate 92 is disposed between the mold 12 and distribution vessel 78 and is formed with similarly registered small openings 94 therethrough and seals the mold against leakage.

To cast the molten metal 16 from the crucible furnace 14 into the casting mold 12, a controlled amount of voltage is applied to the pump 66 which in turn pumps the metal upwardly into the mold 12 with a pressure relating to the applied voltage. Increased voltage produces a corresponding increase in presence output of the pump 66.

Figure 3:
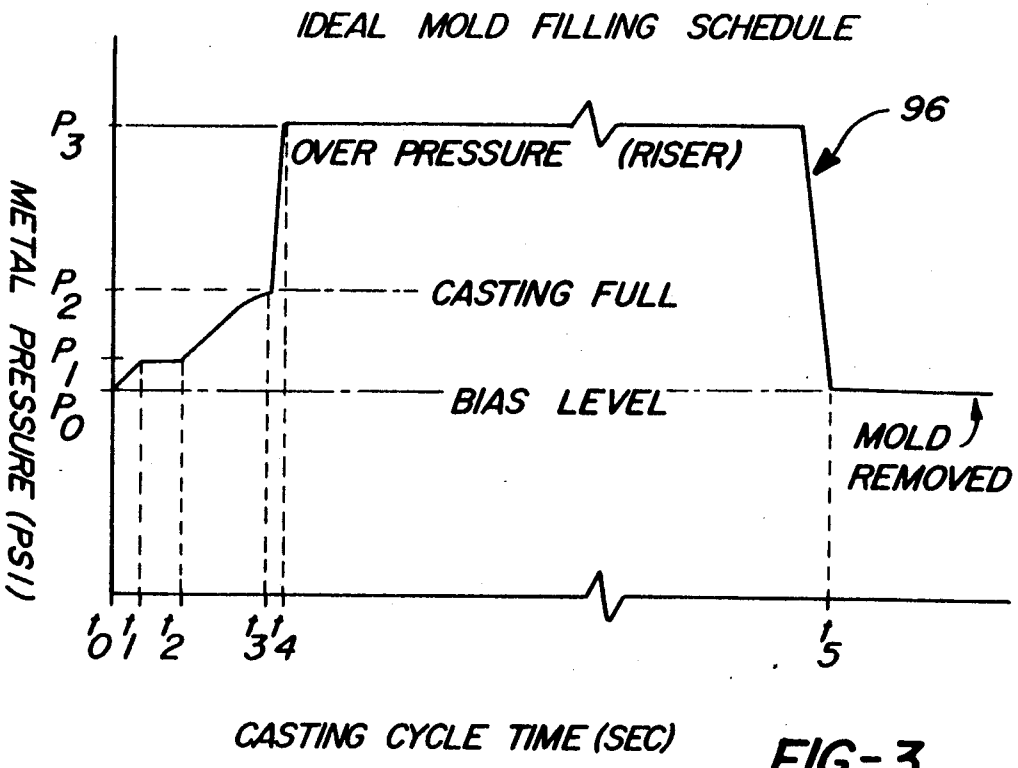
FIG. 3 is a diagrammatic view of a representative metal pressure versus casting cycle time ideal fill schedule for a mold.

For each casting mold configuration, there exists an ideal manner in which the mold cavity should be filled (i.e., a rate of filling the mold). This can be expressed in terms of the head pressure of the pumped metal (which corresponds to the height of the metal as it rises in the mold) versus casting cycle time. A representative ideal metal pressure versus casting cycle time mold filling schedule is illustrated in FIG. 3 and indicated generally by the reference numeral character 96.

In order to conform the actual mold filling rate with that of the ideal mold filling schedule 96, the apparatus 10 is provided with feedback control means 98. The control means 98 is a closed-loop system which continuously measures the actual pressure of the pumped metal during the casting cycle and controls the output of the pump 66 in order to conform the actual metal pressure with the ideal metal pressure versus casting cycle time mold filling schedule 96. In other words, the feedback control means 98 monitors the actual rate at which the mold 12 is filled through direct measurements of the actual metal pressure and then makes necessary changes to the voltage supplied to the pump 66 in order to adjust the output of the pump 66 and maintain the actual filling conditions according to the ideal mold filling schedule.

The feedback control means 98 comprises sensor means 100 for continuously sensing the actual pressure of the pumped metal and generating feedback information representative of the actual metal pressure. The sensor means 100 includes a pressure sensor 102 and a differential pressure transducer 104. The pressure sensor 102 is coupled to the feed tube 76 for directly interacting with the pumped metal and sensing changes in actual pumped metal pressure. To accommodate the sensor 102, the feed tube 76 is specially constructed with a vertical main body portion 106 establishing a generally vertical guide path for the pumped molten metal from the pump 66 to the distribution vessel 78 and a diverging branched portion 108 projecting outwardly and upwardly in relation to the main body portion 106 by about 45° and is fluidly coupled with the main body portion 106 for allowing a portion of the pumped metal to enter the branched portion of the tube 76.

Figure 2:
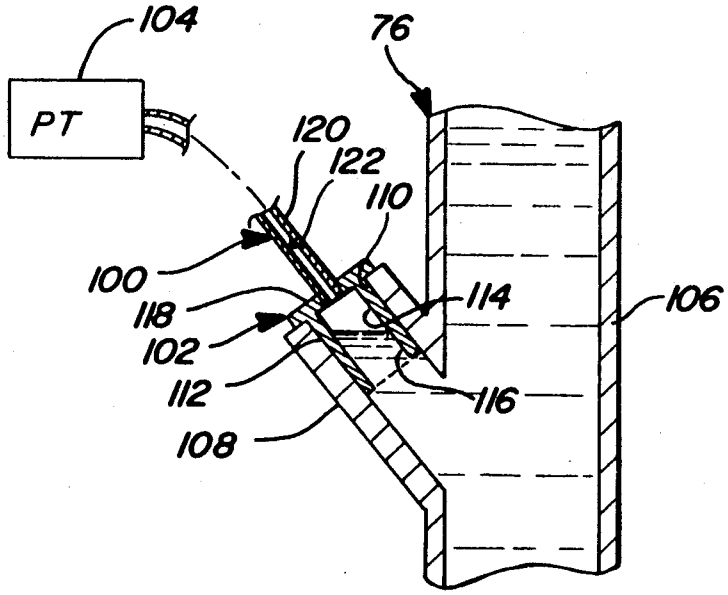
FIG. 2 is a fragmentary cross sectional view of the fill tube illustrating the construction and operation of the pressure sensor.

A portion of the pressure sensor 102 extends through and into an open distal end 110 of the branched portion 108 of the feed tube 76 for directly interacting with the molten metal therein. The extended through portion of the sensor means 100 comprises a heat-resistant titanium metal sleeve 112, the side walls of which define a chamber 114 within the sleeve 112. The extended end 116 of the sleeve 112 is open for establishing fluid communication between the chamber 114 and the fluid passageway within the feed tube 76. Since the sleeve 112 is accommodated within the branched portion 108, the extended open end 116 of the sleeve 112 is directed downwardly toward the crucible furnace 14 as shown in FIG. 2. The other end of the sleeve 112 is formed with a cap 118 which is welded or otherwise securely fastened to the branched portion 108 for sealing the distal end 110 of a branch portion 108 against metal leakage.

The pressure sensor 102 further includes a capillary tube 120 having another chamber 122 therein. The tube 120 is coupled at one of its ends to the cap 118 of the sleeve 112 with the chambers 114, 122 in fluid communication and joined at its other end to the pressure transducer 104. In a preferred construction, the volume capacity of the chamber 114 of the sleeve 112 is at least twice that of the chamber 122 of the capillary tube 120. This size relationship prevents the pumped metal from entering the capillary tube 120 and causing damage thereto.

As metal is being pumped under pressure, a portion of the pumped metal is caused to enter the open end 116 of the sleeve 112 and pressurize a pocket of air or other gaseous fluid captured within the chambers 114 and 122 of the sleeve 112 and capillary tube 120, respectively. The amount the molten metal rises in the sleeve 112 determines the amount the pocket of air within the pressure sensor 102 is pressurized and is representative of the actual metal pressure. Thus, any change in metal pressure is directly sensed by a corresponding change in the pressure of the air pocket.

The pressure transducer 104 is responsive to pressurization of the air pocket and generates feedback information in the form of voltage to a digital process controller (DPC) 124 through line 126. The feedback information is also representative of the actual pressure of the pumped metal. The DPC is a commercially available unit (Sixnet #60 - IOMUXMD-RTU) which has an analog/digital interface or converter built into the unit for converting the analog feedback information into usable digital form.

The feedback control system 98 also includes a programmable logic controller (PLC) 128 coupled to both the DPC 124 and the pump 66. The PLC 128 is commercially available from Texas Instruments, model number 545. The PLC 128 is programmed with the ideal reference metal pressure versus casting cycle time mold filling schedule of FIG. 3 and provides this as set point input information to the DPC 124 through line 130 in the form of voltage.

The DPC 124 is equipped with comparator means for comparing the actual output of the pump provided by the feedback information with the desired output represented by the set point information and then acts to reduce the difference between the two to zero. The DPC 124 acts by generating difference valve information provided to the PLC 128 through line 132 in the form of voltage representative of difference between the feedback information and the set point values. Any difference reflects a diversion from the ideal mold filling schedule 96.

The PLC 128 responds to the difference value information by generating control signals to the pump 66 through line 134 at preselected control intervals for correcting the output of the pump in order to reduce the difference between actual pump output and ideal pump output to zero. The control signal information to the pump 66 is in the form of corrective voltage (i.e., increasing, decreasing, or unchanged input voltage) for increasing, decreasing or maintaining the actual pumped metal pressure according to the ideal schedule 96. The PLC 128 delivers a control signal to the pump 66 about once every 5 milliseconds.

When casting an article with the subject apparatus 10, the appropriate mold is first selected and positioned on the distribution vessel 78 with the feed gates 28 aligned with the distribution holes 90.

The PLC 128 is programmed with the ideal mold filling date schedule information of FIG. 3 which indicates that at the start of each casting cycle, the metal is at a bias level B within the distribution vessel 78, which corresponds to a metal pressure of $P_0$. Between the casting cycle times $t_0$ and $t_1$, the initial pressure is scheduled to be increased from $P_0$ to $P_1$ in order to raise the metal from the bias level B up to the inlets of the mold 12 where it then dwells for a short period from $t_1$ to $t_2$. The metal pressure is then scheduled to increase from $P_1$ to $P_2$ between the times $t_2$ to $t_3$ to completely fill mold cavity 24 with molten metal.

This filling schedule produces a slow, tranquil fill of the mold 12 and assures that even very thin sections of the mold cavity 24 are filled and that no turbulence is experienced as the metal rises in the mold 12. As shown in FIG. 3, just before the mold cavity 24 has reached the completely full mark, the rate of metal pressure increase (i.e., the mold fill rate) drops off slightly. This is to prevent hydraulic hammering of the molten metal against the upper cavity wall which might cause metal penetration into the mold, undesirable flashing at the parting line 22, or mold breakage.

At time $t_3$, the molten metal contacting the cavity walls will have solidified thereby forming an impenetrable skin or shell around the casting. The metal in the feed gate inlets 28, however, remains molten. Once the casting is full and the outer skin developed, the metal pressure is scheduled to rapidly increase from $P_2$ to $P_3$ over the time period from $t_3$ to $t_4$ in order to force additional molten metal into the mold cavity 24 to compensate for any shrinkage during solidification of the metal in the mold. The over pressure acts as a riser. This over pressure is scheduled to be maintained until the time $t_3$ at which the metal in the openings 94 of the orifice plate 92 has solidified, after which time the mold is removed and the metal pressure returned to $P_0$ (i.e., the bias level B) in preparation for the next casting.

At all times during the casting cycle, a portion of the pumped metal is present in the chamber 114 of the sleeve 112 and is continuously pressuring the air pocket confined within the sleeve 112 and capillary tube 120. As mentioned, the pressure exerted upon the air pocket is directly related to the pressure of the pumped metal. Increasing the metal pressure thus registers as an increase of pressure of the air pocket. The pressure transducer 104 detects the air pocket pressure and sends feedback information in the form of voltage to the DPC 124. In this way, the pressure sensor 102 continuously monitors and measures the actual output of the pump 66.

The DPC 124 converts the feedback information into usable digital form and makes comparisons between the actual output of the pump 66 and the desired ideal output of the pump 66 provided to the DPC 124 from the PLC 128 as set point information. From this, the DPC 124 determines whether the actual pump output deviates from the desired pump output and then acts to correct any deviation by sending the difference value information to the PLC 128 in the form of voltage. The PLC 128 then makes necessary adjustments to the input voltage to the pump 66 in order to correct the actual pump output so that it conforms with the desired ideal pump output. The corrective voltage signals from the PLC are sent to the pump 66 once every 5 milliseconds. The pressure is controlled throughout the entire casting cycle.

It will be appreciated by those skilled in the art that the ideal mold filling schedule will depend upon the geometry of the mold, the type of metal being cast, the design of the casting equipment, etc. The schedule shown in FIG. 3 is representative of a schedule for casting a cylinder block of an internal combustion engine in which, approximately, $P_0=4$ psi, $P_1=4.5$ psi, $P_2=5.0$ psi, $P_3=6.0$ psi, $t_0=0$ sec, $t_1=2$ sec, $t_2=4$ sec, $t_3=14$ sec, $t_4=15$ sec and $t_5=195$ sec.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A countergravity casting apparatus for countergravity casting molten metal articles within a mold, said apparatus comprising:

a mold (12) having a cavity (24) therein and at least one bottom inlet (28) into said cavity (24);

reservoir means (14) for holding a supply of molten metal to be cast into said mold cavity (24), said mold (12) being supported above said reservoir means (14);

pump means (66) operatively associated with said reservoir means (14) for pumping molten metal against gravity from said reservoir means (14) into said mold (12) through said bottom inlet (28) thereof;

and feedback pressure control means (98) including a fluid pressure-detecting sensor (100) for continuously and directly sensing and measuring the actual pressure of the pumped metal during the casting cycle and controlling the output of said pump means (66) for conforming the actual metal pressure with a preselected reference metal pressure versus casting cycle time mold filling schedule associated with said control means (98).

2. An apparatus as set forth in claim 1 further characterized by said pump means (66) comprising an electromagnetic pump.

3. An apparatus as set forth in claim 2 further characterized by the output of said pump (66) being responsive to input voltage applied to said pump (66).

4. An apparatus as set forth in claim 2 further characterized by said pump (66) being accommodated within said reservoir means (14).

5. An apparatus as set forth in claim 1 further characterized by including a feed tube (76) connected to said pump means (66).

6. An apparatus as set forth in claim 5 further characterized by said fluid pressure-directing sensor (100) being coupled to said feed tube (76).

7. An apparatus as set forth in claim 6 further characterized by said fluid pressure-detecting sensor (100) having a portion of which extends into said feed tube (76) through an opening (110) therein.

8. An apparatus as set forth in claim 7 further characterized by said feed tube (76) having a main body portion (106) establishing a generally vertical guide path for the molten metal and a branched portion (108) accommodating said extended through portion of said fluid pressure-direction (100) therein.

9. An apparatus as set forth in claim 8 further characterized by said branch portion (108) projecting outwardly and upwardly from said generally vertical main body portion (106).

10. An apparatus as set forth in claim 7 further characterized by said fluid pressure-detecting sensor (100) confining a pocket of gaseous fluid therein and said extended through portion allowing a portion of a pumped metal to enter said fluid pressure-detecting sensor (100) and pressurizing said pocket of gaseous fluid therein by an amount corresponding to the actual pressure of the pumped metal.

11. An apparatus set forth in claim 10 further characterized by said extended through portion of said fluid pressure-detecting sensor (100) comprising a heat-resistant sleeve (112) having side walls of which define a chamber (114) therein, said sleeve being open at one end (116) for admitting the molten metal therein, said sleeve (112) being coupled at an opposite end (118) to a capillary tube (120) having another chamber (122) therein which is in fluid communication with said chamber (114) of said sleeve (112), said chambers (114, 122) together confining the pocket of gaseous fluid within said fluid pressure-detecting sensor (100).

12. An apparatus as set forth in claim 11 further characterized by said fluid pressure-detecting sensor (100) comprising a pressure transducer (104) coupled to said capillary tube (120) for continuously measuring the pressure exerted by said pocket of captured gaseous fluid and generating said feedback information in the form of voltage.

13. An apparatus as set forth in claim 11 further characterized by said sleeve (112) being fabricated of titanium metal.

14. An apparatus as set forth in claim 11 further characterized by said chamber (114) of said sleeve (112) being at least twice the volume capacity of said chamber (122) of said capillary tube (120).

15. An apparatus as set forth in claim 1 further characterized by said feedback control means (98) including comparator means for comparing feedback information of the pressure-detecting sensor (100) with the preselected reference metal pressure versus casting cycle time mold filling schedule information and generating difference value information representative of the difference between the feedback information and the reference metal pressure versus casting cycle time filling schedule information.

16. An apparatus as set forth in claim 15 further characterized by said comparator means comprising a process controller (124).

17. An apparatus as set forth in claim 16 further characterized by said difference value information comprising voltage.

18. An apparatus as set forth in claim 15 further characterized by said feedback control means (98) having means responsive to the difference value information for generating control signal information to said pump means (66) at preselected control intervals for controlling the output of said pump means (66) and the flow of the molten metal into the mold cavity (24).

19. An apparatus as set forth in claim 18 further characterized by said means responsive to said difference value information generating said control signal once every 5 milliseconds.

20. An apparatus as set forth in claim 18 further characterized by said means responsive to said difference values information comprising a programmable logic controller (128).

21. An apparatus as set forth in claim 20 further characterized by said control signal information comprising corrective voltage supplied to said pump means (66).

22. A method for controlling the counter gravity casting of molten metal into a mold (12) situated above a reservoir (14) of the molten metal and having a bottom inlet (28) for admitting the molten metal into the mold (12), the underlying reservoir (14) having a pump (66) accommodated therein for pumping the molten metal upwardly into the mold (12), said method comprising the steps of: pumping the molten metal against gravity from the reservoir (14) into the mold (12) with the pump (66); and continuously and directly sensing and measuring the actual pressure of the pumped metal utilizing a fluid pressure-detecting sensor during the casting cycle and controlling the output of the pump (66) to conform the actual metal pressure with a preselected reference metal pressure versus casting cycle time mold filling schedule.

23. A method as set forth in claim 22 including comparing the actual pressure information to the preselected mold fill schedule information and generating difference value information representative of the difference between the actual pressure information and the mold fill schedule.

24. A method as set forth in claim 23 including repeatedly generating control signal information to the pump (66) which is representative of the difference value information for controlling the output of the pump (66) and the countergravity flow rate of the molten metal into the mold (12).

25. A method as set forth in claim 24 including generating the control signal information to the pump (66) in the form of corrective input voltage.

26. A method as set forth in claim 24 including generating a control signal about once every 5 milliseconds.

* * * * *